US006917307B2

(12) United States Patent
Li

(10) Patent No.: US 6,917,307 B2
(45) Date of Patent: Jul. 12, 2005

(54) MANAGEMENT METHOD AND SYSTEM FOR A PARKING LOT

(76) Inventor: Shih-Hsiung Li, 7F-5, No. 23, Sec. 1, Hangchow S. Rd., Taipei (TW)

( * ) Notice: Subject to any disclaimer, the term of this patent is extended or adjusted under 35 U.S.C. 154(b) by 0 days.

(21) Appl. No.: 10/431,532

(22) Filed: May 8, 2003

(65) Prior Publication Data

US 2004/0222903 A1 Nov. 11, 2004

(51) Int. Cl.[7] ..... G08G 1/14

(52) U.S. Cl. ..... 340/932.2; 340/933; 340/995.1; 340/995.17; 194/902

(58) Field of Search ..... 340/933, 995.1, 340/995.17, 928, 932.2, 990, 995, 937, 927, 505, 506, 942; 194/902, 217, 350; 382/103, 107, 209

(56) References Cited

U.S. PATENT DOCUMENTS 5,206,643 A * 4/1993 Eckelt ..... 340/932.2
5,504,314 A * 4/1996 Farmont ..... 235/384
6,107,942 A * 8/2000 Yoo et al. ..... 340/932.2
6,230,868 B1 * 5/2001 Tuxen et al. ..... 340/932.2
6,292,110 B1 * 9/2001 Budnovitch ..... 340/932.2
6,340,935 B1 * 1/2002 Hall ..... 340/932.2
6,650,250 B2 * 11/2003 Muraki ..... 340/932.2

* cited by examiner

*Primary Examiner*—Davetta W. Goins
(74) *Attorney, Agent, or Firm*—Varndell & Varndell, PLLC

(57) ABSTRACT

A management method and system for a parking lot utilizes multiple parking space sensors to detect the using status of each parking space. A computer is provided to connect to all parking space sensors and controls a display board that is placed at the entrance of the parking lot to show which position is available. Thus, the display board provides the guiding function to the vehicle driver that enters the parking lot. Further, the guiding function is performed by multiple modules mounted on all paths in the parking lot to identify a proper direction so that an available position is easily found.

14 Claims, 4 Drawing Sheets

MANAGEMENT METHOD AND SYSTEM FOR A PARKING LOT

BACKGROUND OF THE INVENTION

1. Field of Invention

The present invention relates to a manage method and system for a parking lot, and more particularly to a management method that is able to display a current parking situation of the parking lot, and efficiently guide drivers to an available parking space.

2. Related Art

To park the car is always a nightmare for those people who live in the city because of the lack of the parking spaces. Therefore, the commercial parking lot is developed to solve the problem. However, if the parking lot does not have an efficient management system, drivers experience difficulty in finding an available position. For example, the conventional management method is to hire staff that go around and inspect the entire parking lot, and then direct the drivers to a proper position. Obviously, such low efficiency management method uses up significant human resources and time.

A management method and system for a parking lot in accordance with the present invention obviates or mitigates the aforementioned drawbacks.

SUMMARY OF THE INVENTION

The main objective of the present invention is to provide a management method and system for a parking lot to show the using status of the parking lot and guide the driver to an available parking space.

To achieve the objective, the management method is performed by the following steps.

1. Define coordinate data of the parking spaces.

2. Sense a using status of each parking space to recognize whether the parking space is available;

3. Gather all the using statuses of the all parking spaces; and

4. Display the gathered using status at the entrance of the parking lot and guiding a vehicle that enters the parking lot to find an available parking space.

Furthermore, the management system includes:

multiple parking space sensors each applied to detect a using status of one of the parking spaces;

a computer connected to the parking space sensors to gather all using statuses of the parking spaces;

an information display board designed to accord with the arrangement of the parking spaces in the parking lot so that the using status of each parking space is individually shown on the information display board.

Other objectives, advantages and novel features of the invention will become more apparent from the following detailed description when taken in conjunction with the accompanying drawings.

DETAILED DESCRIPTION OF THE INVENTION

The present invention is a management method for a parking lot having multiple parking spaces, the method comprising the following steps:

defining coordinate data of the parking spaces;

sensing a using status of each parking space to recognize whether the parking space is available;

gathering all the using statuses of the all parking spaces; and displaying the gathered using statuses at the entrance of the parking lot and guiding a vehicle that enters the parking lot to find an available parking space.

Figure 1:
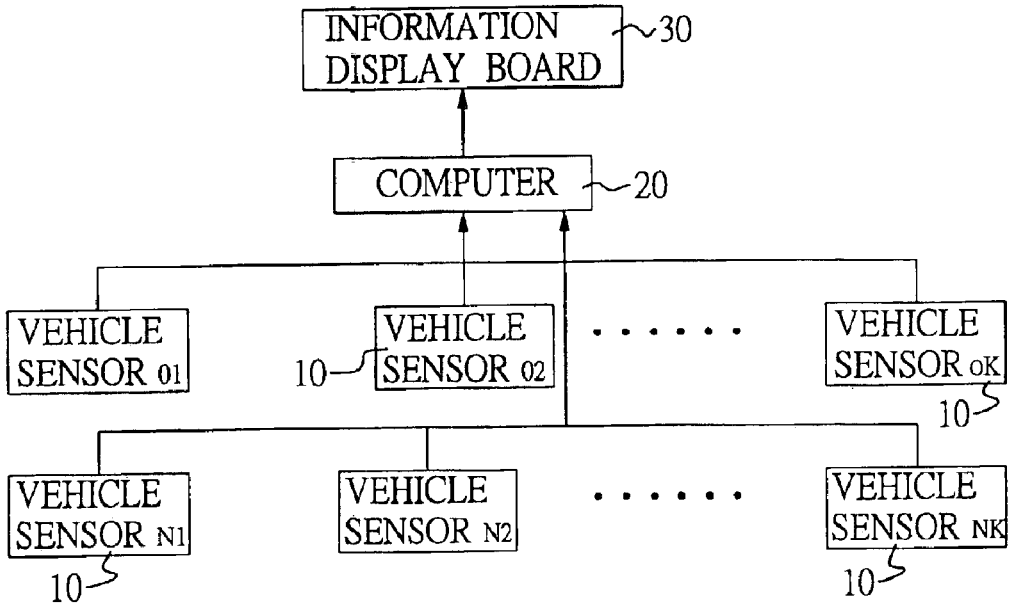
FIG. 1 is a block diagram of a management system for a parking lot of the present invention.
Figure 2:
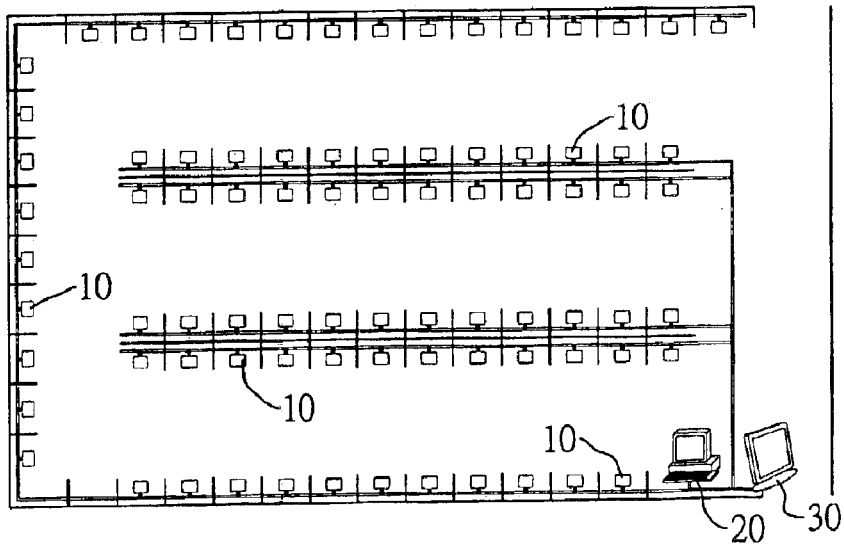
FIG. 2 is a schematic view of a parking space of the present invention.

The foregoing method is performed by a management system. With reference to FIGS. 1 and 2, the management system includes multiple parking space sensors (10), a computer (20) and an information display board (30) that is placed at the entrance of the parking lot, for example.

The multiple parking space sensors (10) are respectively distributed at the parking spaces in the parking lot to detect whether the parking space is available.

The computer (20) connects to each parking space sensor (10) to gather the information related to the parking space.

The information display board (30) connects to the computer (20) to show the situation of the parking lot. The information display board (30) is designed to accord with the arrangement of all parking spaces in the parking lot, so that the situation of each parking space is individually shown on the board (30). After the computer (20) collects the data of all parking space sensors (10), these data are shown on the information display board (30) to guide users for finding an available parking space.

The parking space sensor (10) can be chosen from an induction coil, an ultrasonic sensor, an infrared sensor, a microwave sensor or a pressure sensor.

For example, if the induction coil is adopted as the parking space sensor (10), the induction coil is embedded in each parking space. When a vehicle is parked in the parking space, the inductance value of the coil will increase due to the metallic material of the vehicle. Thus, by detecting the inductance value variation, it is able to be known whether the parking space has the vehicle parked thereon.

When the parking space sensor (10) is chosen as a pressure sensor, the pressure sensor is also embedded in the parking space. By detecting the pressure variation, whether a vehicle is on the parking space is known.

If the parking space sensor (10) is an ultrasonic sensor, the ultrasonic sensor is mounted on the wall that is perpendicularly adjacent to the ground of the parking space. When the parking space has the vehicle parked thereon, the emitted ultrasonic signals will reflect from the vehicle to the parking space sensor, so the vehicle is detected. When the parking space sensor (10) is a microwave sensor, the application of the microwave sensor is substantially the same as an ultrasonic sensor, so the related description is omitted.

If the parking space sensor (10) is chosen from the infrared sensor, an infrared signal emitter and an infrared detector are respectively mounted on the two opposite sides of the parking space. Once a car is on the parking space, the emitted infrared signal is blocked by the car so the infrared detector can not receive any signals, and thus the vehicle is detected.

Because all the parking space sensors (10) are operated independently, there is no interference problem among these parking space sensors (10). When the computer (10) reads the status data of the parking space sensors (10), each parking space sensor (10) is repeatedly questioned by the computer (10), for example, per ten milliseconds (10 ms). Then, the computer (10) will control the information display board to show "AVAILABLE" or "OCCUPIED" based on the detected status. In the event that there is no response from the parking space sensor (10), an "UNKNOWN" message is displayed. If the "UNKNOWN" status has lasted for a while, a "FAILURE" message will then be shown at a position that corresponds to the parking space on the information board (30).

As an example, in such a condition that the scanning ratio of the computer (10) is 10 ms and the parking lot has one thousand parking spaces, the computer (10) can immediately gather all information in ten seconds.

Furthermore, since the status of each parking space is shown on the information display board (30), different statuses of the parking space are represented with different color indicating lights.

For example, the green indication light represents "AVAILABLE", the yellow lights represents "OCCUPIED", the white light is "UNKNOWN" and the red indicating light means "FAILURE".

The connection between the computer (20) and the information display board (30) is one-to-one, and the connection between the computer (20) and all parking space sensors (10) is deemed as one-to-plural. Thus the connection between the computer (20) and all parking space sensors (10) concerns the operation safety and stability. For example, all parking space sensors (10) may divided into several groups each of which is composed of 10 to 128 parking space sensors (10). Each group is then connected to the computer (20) via an individual data bus.

Figure 3:
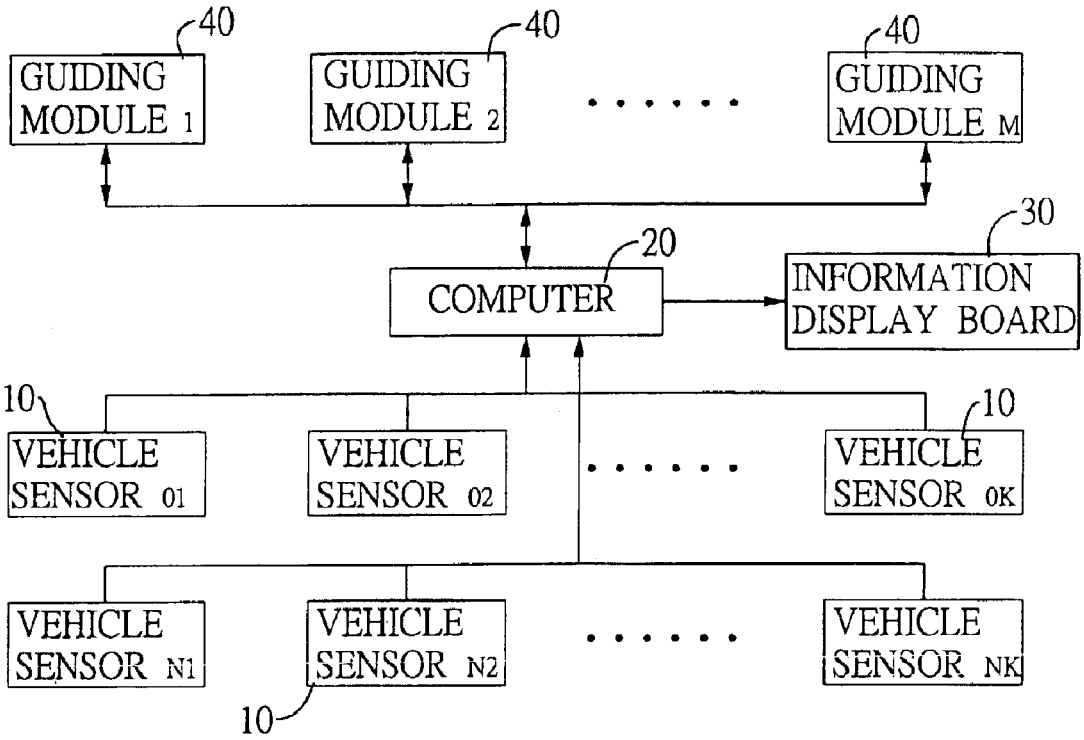
FIG. 3 is a block diagram of a second embodiment of the management system of the present invention.
Figure 4:
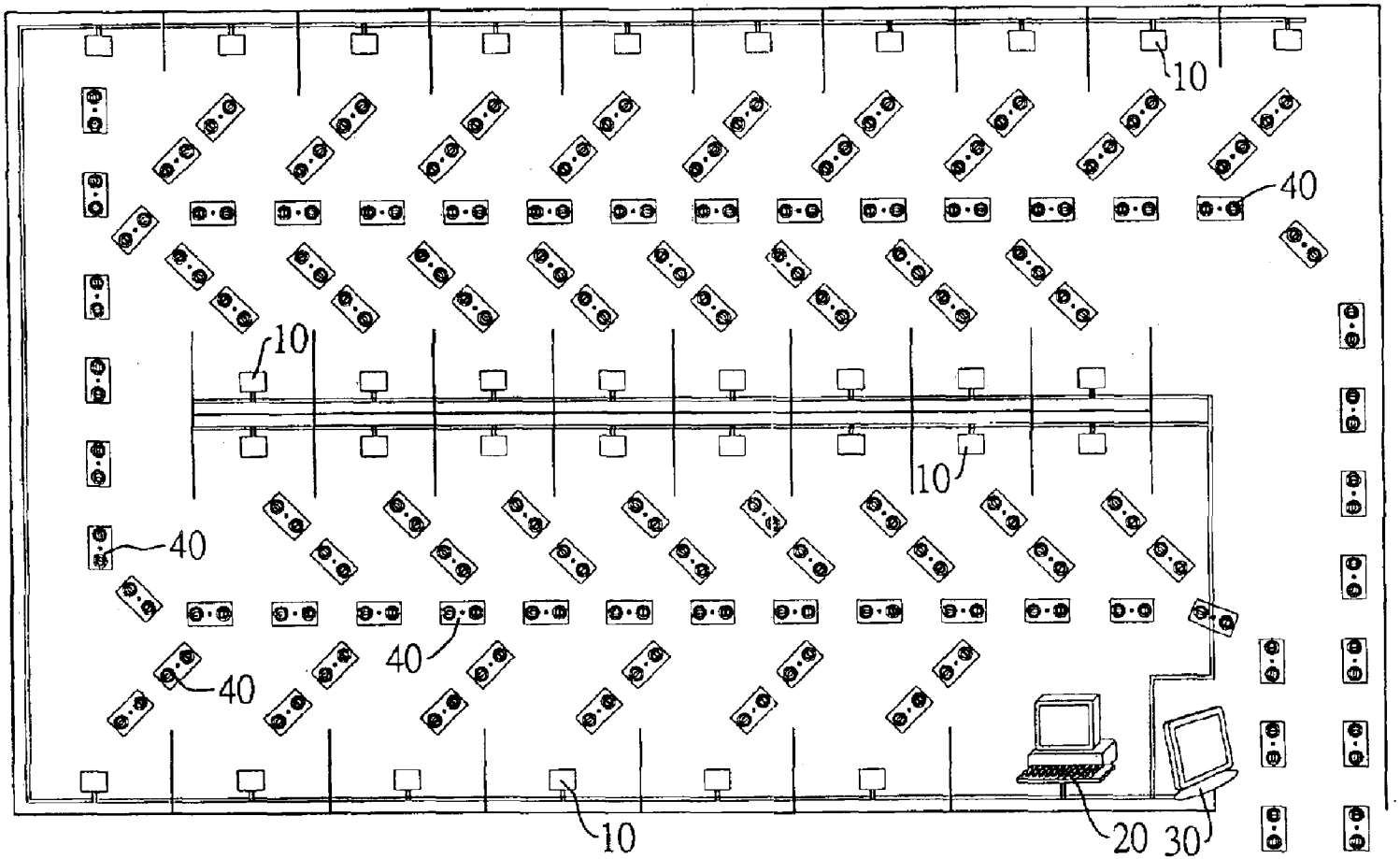
FIG. 4 a schematic view of a parking lot.

With reference to FIGS. 3 and 4, to improve the management efficiency of the present invention, guiding modules (40) are applied on the paths of the parking lot to assist drivers to find an available parking space.

Figure 5:
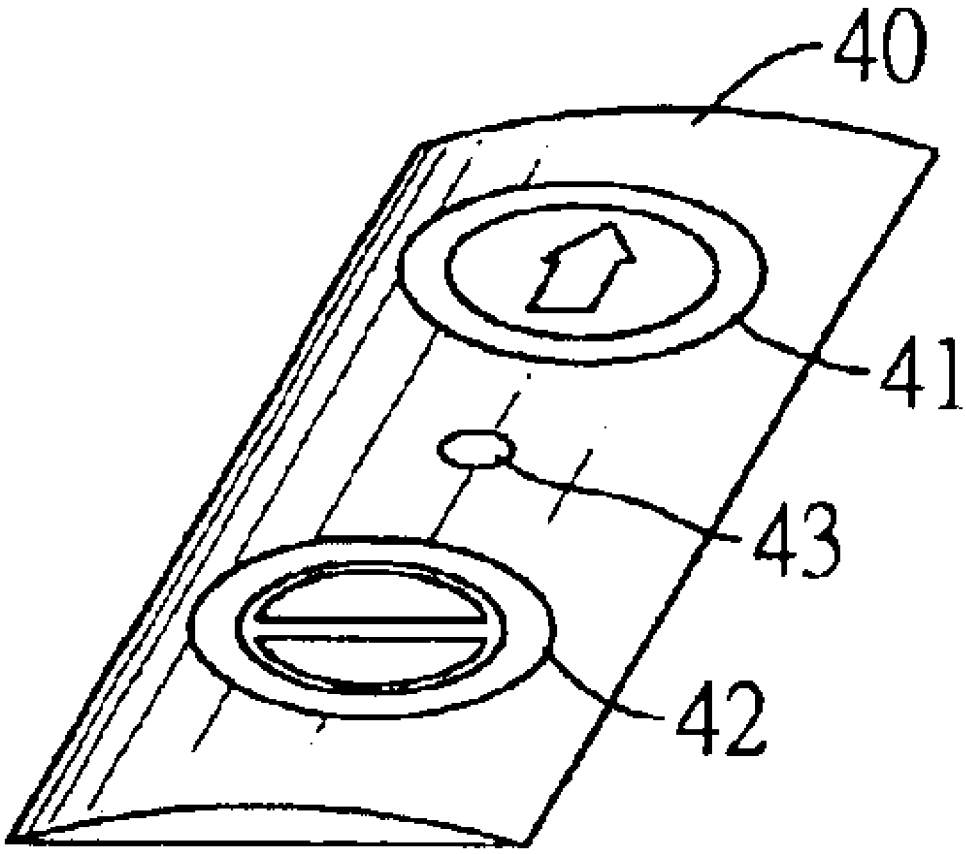
FIG. 5 is a perspective view of a guiding module in accordance with the present invention.

With reference to FIG. 5, the guiding module (40) includes a direction light (41), a stop light (42) and a vehicle sensor (43). The connection for the vehicle sensors (43) is substantially the same as the foregoing vehicles sensors (10). The vehicle sensors (43) are also divided into several groups and each group is connected to the computer (20) via an individual data bus.

All the vehicle sensors (43) are able to respond to the moving information of the vehicles to the computer (20), whereby the computer (20) determines a proper path and activates the guiding modules (40) to show the path to the drivers.

For example, if the direction lights (41) are activated to emit green light, it means the driver can follow the direction lights (41) to find a proper parking space. Otherwise if the stop lights (42) are activated to emit red light, it means travel along the path is prohibited.

The vehicle sensors (43) mentioned above are chosen from the ultrasonic sensors or the microwave sensors. Thus, when any vehicle passes through the vehicle sensors (43), the perpendicularly emitted signals are reflected from the bottom of the vehicle so the computer (20) obtains the information of the moving vehicles.

The invention may be varied in many ways by a skilled person in the art. Such variations are not to be regarded as a departure from the spirit and scope of the invention, and all such modifications are intended to be included within the scope of the following claims.

What is claimed is:

1. A management method for a parking lot having multiple parking spaces and an entrance, the method comprising:

defining coordinate data of the parking spaces;

sensing a status when each parking space is vacant and occupied;

sensing movement of vehicles passing through the parking lot;

gathering the statuses of all the parking spaces and the movement of vehicles passing through the parking lot;

displaying the gathered statuses for parking spaces at the entrance of the parking lot;

determining a path to an available parking space; and showing the determined path to the available parking space to a vehicle that entered the parking lot by direction lights arranged around the parking lot.

2. The management method as claimed in claim 1, wherein at least one of the direction lights for showing the determined path to the available parking space is arranged in each of the parking spaces.

3. The management method as claimed in claim 1, wherein two of the direction lights for showing the determined path to the available parking space are arranged in each of the parking spaces.

4. A management system for a parking lot having a plurality of parking spaces, at least one path to the plurality of parking spaces, and an entrance; the management system comprising:

parking space sensors detecting a status of a respective one of the parking spaces between vacant and occupied;

an information display board arranged at the entrance to the parking lot and individually displaying the status of each parking space;

guiding modules mounted on all paths of the parking lot; the guiding modules including a direction light, a stop light, and a vehicle sensor; the vehicle sensor detecting movement of vehicles passing through the guiding modules; and a computer connected to the parking space sensors, the information board, and the guiding modules; the computer receiving the statuses of the parking spaces detected by the parking space sensors and the movement of vehicles detected by the guiding modules; displaying the statuses of the parking spaces on the information board; determining a path to an available parking space; and coordinating the display of the direction lights and the stop lights of the guiding modules for showing the path to the available parking space to a vehicle as the vehicle travels toward the available parking space.

5. The management system as claimed in claim 4, wherein the parking space sensors are chosen from an induction coil, an ultrasonic sensor, an infrared sensor, a microwave sensor, or a pressure sensor.

6. The management system as claimed in claim 4, wherein the parking space sensors are divided into multiple groups, wherein each group is connected to the computer via an individual bus.

7. The management system as claimed in claim 5, wherein the parking space sensors are divided into multiple groups, wherein each group is connected to the computer via an individual bus.

8. The management system as claimed in claim 4, wherein the computer repeatedly and periodically gathers the detected status of each parking space sensor and the detected movement of vehicles.

9. The management system as claimed in claim 5, wherein the computer repeatedly and periodically gathers the detected status of each parking space sensor and the detected movement of vehicles.

10. The management system as claimed in claim 5, wherein the information display board has four different color indicating lights to show the status of the parking spaces.

11. The management system as claimed in claim 4, wherein each vehicle sensor is an ultrasonic sensor or a microwave sensor.

12. The management system as claimed in claim 4, wherein at least one of the guiding modules is arranged within each path of the parking lot, and the module displays the stop light thereof when no parking spaces are available along the path and displays the direction light thereof when a parking space is available along the path.

13. The management system as claimed in claim 4, wherein at least one of the guiding modules is arranged within each of the parking spaces.

14. The management system as claimed in claim 4, wherein two of the guiding modules are provided for each of the parking spaces.

* * * * *